United States Patent [19]

Braem et al.

[11] Patent Number: 4,834,117

[45] Date of Patent: May 30, 1989

[54] FILTER FOR A SMOKING ARTICLE

[75] Inventors: Daniel Braem, Les Hauts-Geneveys; Ahmed Abdelgawad, Colombier, both of Switzerland

[73] Assignee: Fabriques de Tabac Reunies, S.A., Neuchatel, Switzerland

[21] Appl. No.: 72,685

[22] Filed: Jul. 13, 1987

[30] Foreign Application Priority Data

Aug. 19, 1986 [GB] United Kingdom ..... 8620109

[51] Int. Cl.[4] ..... A24D 3/04

[52] U.S. Cl. ..... 131/336

[58] Field of Search ..... 131/336

[56] References Cited

U.S. PATENT DOCUMENTS

| | | | |
|---|---|---|---|
| 3,847,161 | 11/1974 | Morgenstern . | |
| 4,527,573 | 7/1985 | Hausermann | 131/336 |
| 4,601,298 | 7/1986 | Nichols et al. | 131/336 |

*Primary Examiner*—V. Millin

*Attorney, Agent, or Firm*—Jeffrey H. Ingerman

[57] ABSTRACT

A filter for a smoking article comprises a mouth-end section and a rod-end section, the opposed faces of which are so shaped that, on relative rotation they perform a camming action on each other, so that a variable volume air-smoke mixing chamber is formed. Ambient air passes into the air-smoke mixing chamber through perforations 22 in the wrapping.

11 Claims, 3 Drawing Sheets

FILTER FOR A SMOKING ARTICLE

This invention relates to filters for smoking articles such as cigarettes and in particular to such filters having performance characteristics which may be varied by the smoker.

It has been proposed to provide a filter for a smoking article comprising a mouth-end portion and a co-axial rod-end portion, both circumscribed by a substantially air-impermeable wrapping, the filter portions being relatively rotatable about the axis of the filter. Relative rotation of the filter portions by the smoker serves to alter a characteristic of the filter, such as the amount of ambient air allowed into the filter body, or the resistance to draw of the filter.

Previously proposed variable dilution filters have admitted air into the filter body, for mixture therein with smoke.

The present invention provides a filter for a smoking article comprising a mouth-end filter portion and a rod-end filter portion co-axial with the mouth-end portion, the filter portions being circumscribed by tipping and being relatively rotatable about the axis of the filter characterised in that at least parts of the opposed faces of the filter portions bear on each other and in that the opposed faces are so shaped that, on relative rotation of the filter portions about the axis of the filter, they perform a camming action on each other, whereby, on relative rotation of the filter portions, the volume defined by the opposed faces in the tipping is varied.

In preferred embodiments, the opposed faces of the filter portions are complimentary so that, in one relative angular position of the filter portions, the volume defined by the opposed faces of the filter portions and the tipping is zero. In particularly preferred embodiments, the tipping is substantially air transmissive only in the region of the variable volume formed by the relative rotation of the filter portions.

It is also preferred that the tipping comprises mouth-end and rod-end sections, respectively attached to the mouth-end and rod-end filter portions for movement therewith. An outer sleeve affixed to the mouth-end section of tipping for movement therewith is advantageously provided.

In the most preferred embodiments, the axial regions of the opposed faces of the filter portions are interconnected.

The invention also provides smoking articles including filters according to the invention.

The invention will be further described, by way of example, with reference to the drawings, in which.

In the drawings, like components are identified by the same reference numerals throughout, and surfaces which are fixed to each other are shown by heavy lines.

Figure 1:
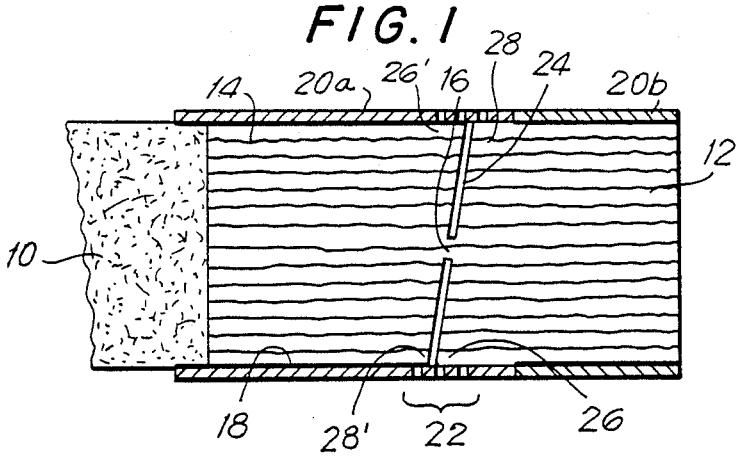
FIG. 1 shows a section through a cigarette having a filter according to a first preferred embodiment of the invention, in the closed condition.

Preferred filters according to the invention are shown in the drawings attached to a wrapped tobacco rod 10. The filters, the bodies of which may be formed, for example, of acetate tow, and which may be wrapped, comprise a mouth-end portion 12 co-axial with and bearing on a rod-end portion 14. The two filter portions 12 and 14 are held for relative rotation, preferably by being interconnected between the axial regions of their opposed faces. In all the embodiments shown in the drawings, this interconnection is achieved by an isthmus 16 of filter material, integral with both filter portions. This preferred arrangement is achieved by forming the filter portions from a single length of filter material by cutting almost completely across the length, but leaving the isthmus 16 uncut.

In the preferred embodiments shown, the surface 18 of the filter portions is air impermeable. However, the filter surface may be air permeable. Both portions are circumscribed by a tipping 20 comprising a rod-end section **20*a* attached only to the rod-end filter portion 14 but extending also over part of the mouth end filter portion 12, and a mouth end section 20*b* attached only to the mouth-end filter portion 12. Preferably, the tipping 20 is air impermeable, but is provided with an air transmissive zone, by means, for example, of perforations 22, in the region of the interface between the filter portions 12 and 14. In the preferred embodiments shown, the tipping 20 joins the filter body to the tobacco rod 10**.

The opposed faces of the filter portions 12 and 14 are so shaped that, on relative rotation about the axis of the filter, they perform a camming action on each other, causing the mouth-end portion 12 to move relative to the rod-end portion along the filter axis, thus altering the volume of the air-smoke mixing chamber defined by the two opposed faces of the filter portions 12 and 14 and the tipping 20.

Figure 2:
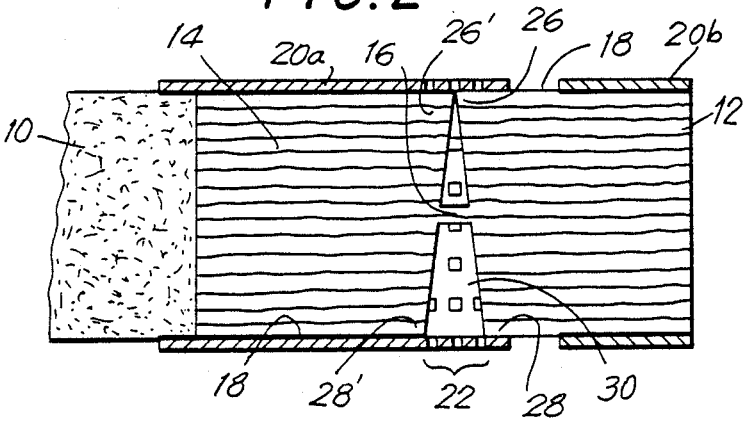
FIG. 2 shows a section through the cigarette of FIG. 1, with the filter in the fully opened condition.
Figure 4:
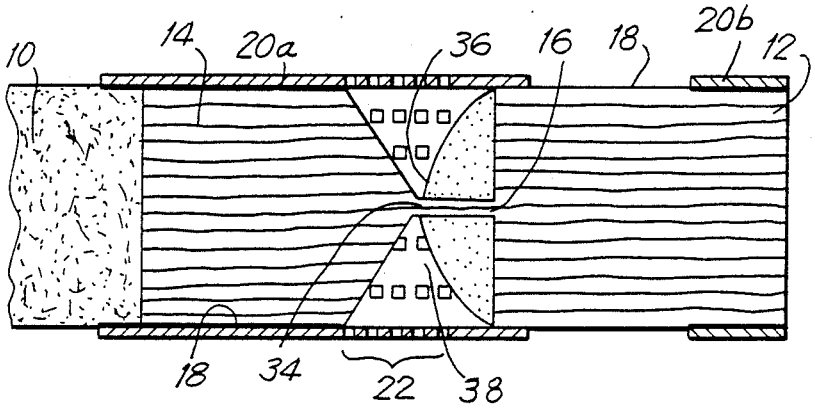
FIG. 4 shows a section through the cigarette of FIG. 3 with the filter in the fully open condition, on the same plane as that shown in FIG. 3.

As is best seen in FIGS. 2 and 4, since the mouth-end section **20*b* of the tipping is attached only to the mouth-end portion 12 of the filter, as the two filter portions move apart, the mouth-end section 20*b* of the tipping moves with the mouth-end portion 12** of the filter, ensuring that the part of the filter which enters the smoker's mouth is wrapped in tipping.

In the first preferred embodiment, shown in FIGS. 1 and 2, the two filter portions 12 and 14 are divided by a single planar cut 24, skew to the axis of the filter. This gives the mouth-end filter portion 12 and the rod-end filter portion 14 long sides 26, 26' respectively sloping to short sides 28, 28' respectively. The cut 24 does not extend right through the filter body, but leaves uncut the isthmus 16 which serves to prevent complete separation of the mouth-end filter portion 12 from the rest of the filter.

In FIG. 1, the filter is shown in the closed condition. The whole of the opposed faces of the filter portion 12 and 14 bear on each other with the long side 26 of the mouth-end filter portion registering with the short side 28' of the rod-end filter portion, and the volume of the air smoke mixing chamber is zero. In preferred embodiments, in which the filter body surface 18 is air impervious, substantially no air enters the smoke stream.

On rotation of the mouth-end filter portion 12 relative to the rod-end filter portion 14, the filter moves to the open condition shown in FIG. 2, in this case after rotation of the mouth-end filter portion through 180°. The long side 26 of the mouth-end filter portion 12 moves into register with and bears on the long side 26' of the rod-end filter portion 14, and the short side 28 of the mouth-end filter portion 12 moves into register with the short side 28' of the rod-end filter portion 14, but is separated from it. This creates an air-smoke mixing chamber 30, into which ambient air is drawn through perforations 22 or other ventilation means in the wrapping 20.

Figure 3:
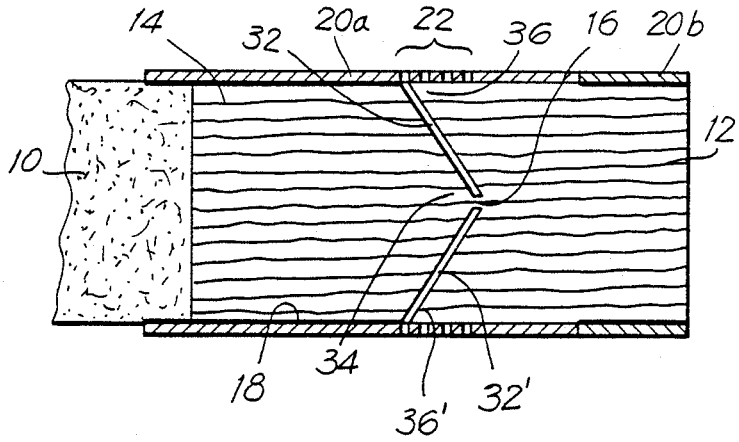
FIG. 3 shows a section through a cigarette having a filter according to a second preferred embodiment of the invention, in the closed condition.

In the second preferred embodiment of the invention, shown in FIGS. 3 and 4, the two filter portions 12 and 14 are divided by two symmetrical planar cuts 32, 32' in the form of a "V" pointing toward the mouth end of the filter, giving a central projection 34 on the rod-end filter portion 14 and edge projections 36, 36' on the mouth-end filter portion 12. It will be appreciated that the 'V' may be pointing toward the rod end of the filter.

In the closed condition, shown in FIG. 3, the whole of the opposed faces of the filter portions 12 and 14 bear on each other, and the air-smoke mixing chamber volume is zero.

On rotation of the mouth-end filter portion 12 relative to the rod-end filter portion 14, in the case shown in FIG. 4 through 90°, the edge projections 36, 36' on the mouth-end filter portion 12 bear onto the central projection 34 on the rod-filter portion 14 causing the filter portions to move apart along the axis of the filter, to form an air smoke mixing chamber 38. Again, ambient air is drawn into the air-smoke mixing chamber 38 through perforations 22 or other ventilation means in the tipping 20. The mouth-end section **20*b* of the tipping moves with the mouth-end filter portion 12 in a similar manner to that described with reference to FIGS. 1 and 2**.

Figure 5:
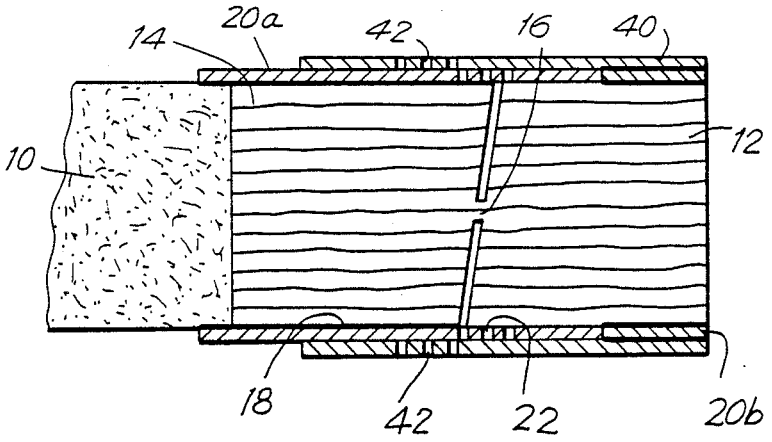
FIG. 5 shows a section through a cigarette having a filter according to a third, particularly preferred, embodiment of the invention, in the closed condition.
Figure 6:
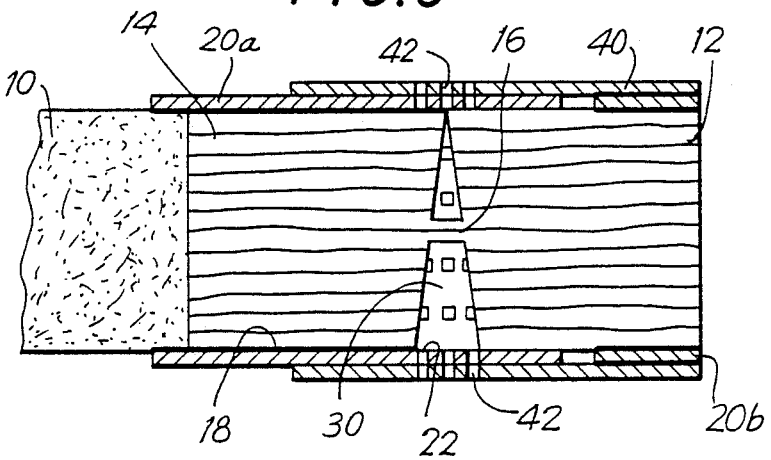
FIG. 6 shows a section through the cigarette of FIG. 5, with the filter in the fully open condition.

The third embodiment, which is a particularly preferred embodiment and is shown in FIGS. 5 and 6, is designed to ensure that, when the filter is in the open condition, the filter plug surface is not visible.

The arrangement of the mouth-end 12 and rod-end 14 filter portions, having an air impermeable surface 18, within the mouth-end **20*b* and rod-end 20*a* sections of tipping is the same as the embodiment of FIGS. 1 and 2. The filter portions are attached to each other by an isthmus 16 of filter material. Perforations 22 are provided in the mouth-end section 20*a* of the tipping in the region of the interface between the two filter portions. The filter is attached by the tipping to a wrapped tobacco rod 10**.

In addition, there is provided an outer sleeve 40 overlying the tipping 20. The mouth-end region of this outer sleeve is attached, by for example gluing, to the mouth-end section **20*b* of the tipping. The outer sleeve 40 is not attached to the tipping anywhere else. The outer sleeve has perforations 42 or other ventilation means which, when the filter is in the closed condition, are to the rod-end side of the perforations 22 in the rod-end section 20*a* of tipping, which underlies the rod-end region of the outer sleeve 40**.

The filter of this embodiment operates in a similar manner to that of FIGS. 1 and 2. On rotation of the mouth-end filter portion 12, the filter moves to the open condition shown in FIG. 6. As the mouth-end section **20*b* of the tipping moves away from the tobacco rod 10, the outer sleeve 40 moves with it. The perforations 42 in the outer sleeve move into registry with those 22 in the rod-end section 20*a* of the tipping, admitting air into the air-smoke mixing chamber 30 formed by the opposed end faces of the filter portions 12, 14 and the rod-end section 20*a* of the tipping. The gap between the mouth-end 20*b* and rod-end 20*a* sections of the tipping when the filter is in the open condition is covered by the outer sleeve 40**. Thus, a filter is provided which presents a uniform appearance in both the open and closed conditions.

An outer sleeve may equally be provided on a filter of the type shown in FIGS. 3 and 4.

In all the embodiments described, the rod-end **20*a* and mouth-end 20*b* sections of the tipping may be separate in the cigarette provided to the smoker, or they may attached to each other along a line of weakness, such as a line of perforations. The perforations are broken when the mouth-end portion 12 of the filter is twisted, since the mouth-end section 20*b* of the tipping is carried with the mouth-end portion 12 of the filter, whilst the rod-end section 20*a* of the tipping remains stationary with the rod-end portion 14** of the filter.

In all the embodiments illustrated, the volume of the mixing chamber 30 or 38 and the degree of ventilation may be varied by varying the relative angular displacement of the filter portions 12 and 14. If desired, the two filter portions 12 and 14 may be interconnected by means other than an isthmus 16 of filter material. This may be necessary, for example, if the relative displacement of the filter portions along the filter axis is too great to be accommodated by the stretching of an isthmus of filter material.

What is claimed is:

1. A filter for a smoking article comprising a mouth-end filter portion and a rod-end filter portion co-axial with the mouth-end portion, the filter portions being circumscribed by tipping and being relatively rotatable about the axis of the filter, said mouth-end portion having a mouth end and a rod end and having a mouth-end face at the mouth end thereof and a rod-end face at the rod end thereof, said rod-end portion having a mouth end and a rod end and having a mouth-end face at the mouth end thereof and a rod-end face at the rod end thereof, said rod-end face of said mouth-end portion opposing said mouth-end face of said rod-end portion, the opposed faces and the tipping defining a volume; wherein:

at least parts of said opposed faces of the filter portions comprise camming surfaces, said camming surfaces bearing on each other, such that on relative rotation of the filter portions about the axis of the filter, the opposed faces move toward and away from each other, whereby the volume defined by the opposed faces and the tipping is varied.

2. A filter according to claim 1 in which the opposed faces of the filter portions are complementary so that, in at least one relative angular position of the filter portions, the volume defined by the opposed faces of the filter portions and the tipping is zero.

3. A filter according to claim 1 in which the tipping is substantially transmissive only in the region of the variable volume formed by the relative rotation of the filter portions.

4. A filter according to claim 1 in which axial regions of the opposed faces of the filter portions are interconnected.

5. A filter according to claim 4 in which the interconnection is by means of an isthmus of filter material integral with both portions.

6. A filter according to claim 1 in which the interface between the filter portions is a single plane.

7. A filter according to claim 1 in which the circumferential surface of the filter portions is substantially air impermeable.

8. A filter according to claim 1 in which the circumferential surface of the filter portions is substantially air permeable.

9. A filter according to claim 1 in which the tipping comprises a mouth-end section affixed to the mouth-end filter portion for movement therewith and a rod-end section affixed to the rod-end filter portion for movement therewith.

10. A filter according to claim 9 further comprising an outer sleeve affixed to the mouth-end section of the tipping for movement therewith and extending over at least a part of the rod-end section of tipping.

11. A smoking article including a filter according to any preceding claim.

* * * * *